US008442415B2

(12) United States Patent
Ushiozu

(10) Patent No.: US 8,442,415 B2
(45) Date of Patent: May 14, 2013

(54) COLOR ELECTROPHOTOGRAPHIC IMAGE FORMING APPARATUS WITH SHUTTER MEMBER ON CARTRIDGE SUPPORTING MEMBER

(75) Inventor: Hidehiro Ushiozu, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 301 days.

(21) Appl. No.: 12/846,300

(22) Filed: Jul. 29, 2010

(65) Prior Publication Data

US 2011/0026966 A1 Feb. 3, 2011

(30) Foreign Application Priority Data

Jul. 31, 2009 (JP) ..... 2009-179746
Jul. 13, 2010 (JP) ..... 2010-158366

(51) Int. Cl.
*G03G 15/01* (2006.01)

(52) U.S. Cl.
USPC ..... 399/110

(58) Field of Classification Search ..... 399/110, 399/111, 116
See application file for complete search history.

(56) References Cited

U.S. PATENT DOCUMENTS 6,236,822 B1 * 5/2001 Kawaguchi ..... 399/114
6,448,994 B1 * 9/2002 Kim et al. ..... 347/228
7,512,362 B2 * 3/2009 Park ..... 399/114
7,684,730 B2 * 3/2010 Furuta et al. ..... 399/121
2010/0054800 A1 * 3/2010 Okabe ..... 399/114

FOREIGN PATENT DOCUMENTS

JP 2001-51578 2/2001

* cited by examiner

*Primary Examiner* — Quana M Grainger
(74) *Attorney, Agent, or Firm* — Fitzpatrick, Cella, Harper & Scinto

(57) ABSTRACT

A color electrophotographic image forming apparatus forms an image on a recording material. A plurality of cartridges is detachably mounted to a main assembly of the apparatus. The apparatus includes a cartridge supporting member for supporting the cartridges. The cartridge supporting member is movable between an inside position inside the main assembly and an outside position outside the main assembly. The apparatus also includes a shutter member movably provided on the cartridge supporting member. The shutter member is movable between an open position in which a photosensitive member supported by the cartridge supporting member is exposed and a closed position in which the photosensitive member is protected. The apparatus further includes a shutter moving device for moving the shutter member to the closed position when the cartridge supporting member is moved from the inside position to the outside position and for moving the shutter member to the open position when the cartridge supporting member is moved from the outside position to the inside position.

7 Claims, 10 Drawing Sheets

COLOR ELECTROPHOTOGRAPHIC IMAGE FORMING APPARATUS WITH SHUTTER MEMBER ON CARTRIDGE SUPPORTING MEMBER

FIELD OF THE INVENTION AND RELATED ART

The present invention relates to a color electrophotographic image forming apparatus, wherein a plurality of cartridges is detachably mounted to an apparatus main assembly, and an image is formed on a recording material.

In the electrophotographic image forming apparatus, a process cartridge prepared by integrally assembling a photosensitive drum and process means actable on the photosensitive drum into a cartridge which is detachably mountable to the apparatus main assembly is used increasingly. In order to prevent the photosensitive drum from being exposed to light when such a process cartridge is demounted from the apparatus main assembly, a shutter member for covering and uncovering an opening through which the photosensitive drum is to be exposed is provided.

As a mounting and demounting constitution of the process cartridge, a constitution in which the process cartridge is supported by a movable member movable relative to the apparatus main assembly and is mountable into and demountably from the apparatus main assembly by pulling out the movable member is used in an image forming apparatus. The image forming apparatus may include a shutter member provided on the movable member and the shutter member is configured to be manually opened and closed. That is, after the movable member is pulled out to a cartridge mounting and demounting position, the shutter member is manually moved to a closed position. When the movable member is returned into the apparatus main assembly, the shutter member is manually moved to an open position (Japanese Laid-Open Patent Application (JP-A) 2001-51578.

Thus, the image forming apparatus in JP=A 2001-51578 employs the constitution in which the shutter member is manually moved. This is because it is assumed that the photosensitive drum is protected when a service person performs maintenance of a developing device and its adjacent portions.

However, in these days, an image forming apparatus of the type wherein the process cartridge is exchanged by a user himself (herself), i.e., a so-called (service person) maintenance-free image forming apparatus, has been used increasingly. In the constitution in which the user manually opens and closes the shutter member when the user exchanges the process cartridge, there are disadvantages such that an operation is hard to understand and thus usability is poor. Further, when the process cartridge is demounted from the apparatus main assembly and is left standing for a long time without closing the shutter member, the photosensitive drum is exposed to light. When the process cartridge is mounted again and is subjected to image formation, there is a possibility that image defect occurs.

SUMMARY OF THE INVENTION

The present invention has been accomplished in view of the above-described problems.

A principal object of the present invention is to provide a color electrophotographic image forming apparatus improved in usability by moving a shutter member in interrelation with movement of a cartridge supporting member which supports a plurality of cartridges.

Another object of the present invention is to provide a color electrophotographic image forming apparatus, wherein a cartridge supporting member which supports a plurality of cartridges is movable between an inside position inside and an outside position outside the apparatus main assembly, capable of preventing a photosensitive member supported by the cartridge supporting member from being exposed to light to the outside position.

According to an aspect of the present invention, there is provided a color electrophotographic image forming apparatus for forming an image on a recording material, wherein a plurality of cartridges is detachably mounted to a main assembly of the apparatus, the color electrophotographic image forming apparatus comprising:

a cartridge supporting member for supporting the cartridges, the cartridge supporting member being movable between an inside position inside the main assembly and an outside position outside the main assembly;

a shutter member movably provided on the cartridge supporting member, the shutter member being movable between an open position in which a photosensitive member supported by the cartridge supporting member is exposed and a closed position in which the photosensitive member is protected; and shutter moving means for moving the shutter member to the closed position when the cartridge supporting member is moved from the inside position to the outside position and for moving the shutter member to the open position when the cartridge supporting member is moved from the outside position to the inside position.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
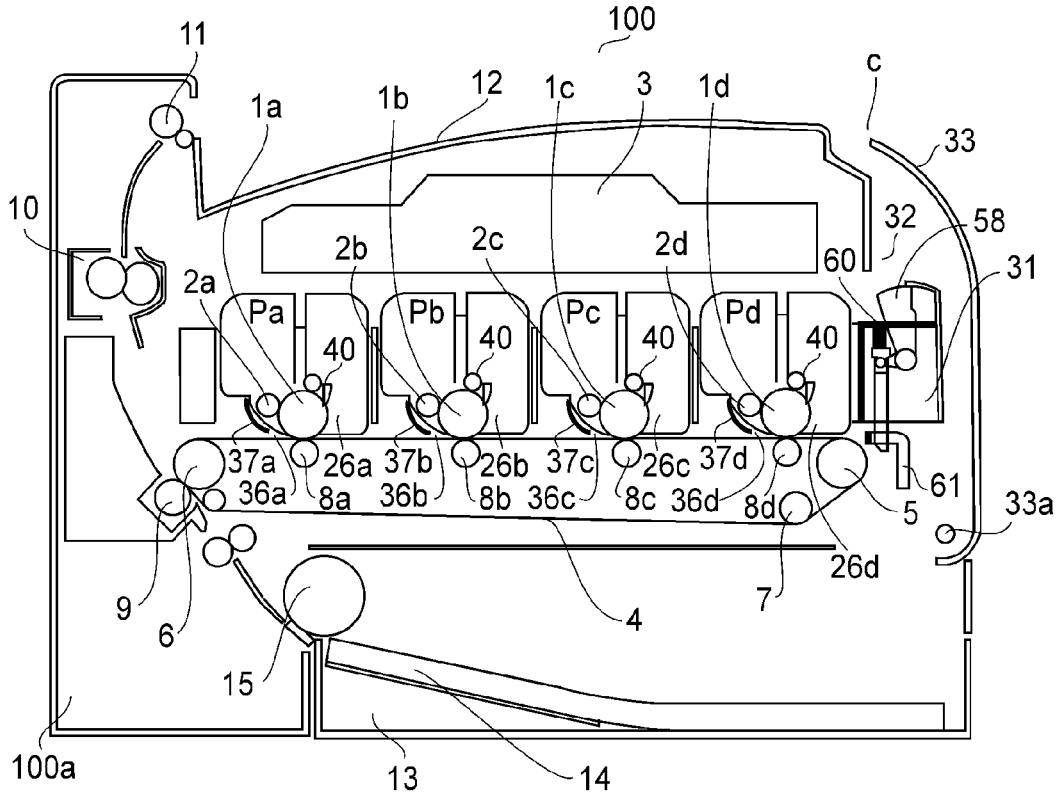
FIG. 1 is a principal sectional view for illustrating an image forming apparatus in First Embodiment.

Referring to the drawings, the description will be made as to a color electrophotographic image forming apparatus, according to an embodiment of the present invention, for forming an image on a recording material, wherein a plurality of cartridges is detachably mounted to an apparatus main assembly of the apparatus.

Here, the color electrophotographic image forming apparatus forms a color image on the recording material using an electrophotographic image forming process. Examples of the color electrophotographic image forming apparatus include a color electrophotographic copying machine, a color electrophotographic printer (color laser beam printer, color LED printer, etc.), a color facsimile machine, and a color word processor.

The image is formed by the electrophotographic image forming apparatus on the recording material, and the recording material may include paper, an OHP sheet, etc.

The cartridge is, e.g., a process cartridge or a developing cartridge or a toner cartridge and contributes to an image forming process for forming the image on the recording material in a state in which the cartridge is detachably mounted in an apparatus main assembly of the electrophotographic image forming apparatus. Here, the process cartridge includes at least one of a charging means, a developing means, and a cleaning means as process means, and an electrophotographic photosensitive drum, which are integrally assembled into a unit (cartridge), and the cartridge is detachably mountable to the apparatus main assembly of the electrophotographic image forming apparatus. Thus, the process cartridge may include the developing means as the process means and the electrophotographic photosensitive drum as the unit, and the unit is detachably mountable to the apparatus main assembly. The process cartridge may include the charging means, the developing means, or the cleaning means as the process means and the electrophotographic photosensitive drum as the unit, and the unit is detachably mountable to the apparatus main assembly.

The process cartridge which is provided integrally with the electrophotographic photosensitive drum and the developing means is called an integral-type process cartridge. The process cartridge which is provided integrally with the electrophotographic photosensitive drum and the process means other than the developing means is called a separation type process cartridge. The process cartridge can be mounted into and demounted form the apparatus main assembly. For this reason, the maintenance of the apparatus main assembly is easy. The process means acts on the electrophotographic photosensitive drum.

The developing cartridge is provided with a developing roller, and accommodates a developer (toner) used for developing an electrostatic latent image formed on the electrophotographic photosensitive drum and is detachably mountable to the apparatus main assembly. In the case of the developing cartridge, the electrophotographic photosensitive drum is mounted in the apparatus main assembly or a cartridge supporting member described later. Alternatively, the electrophotographic photosensitive drum is provided in the so-called separation type process cartridge. In this case, the process cartridge is not provided with the developing means. The developing cartridge can also be mounted into and demounted from the apparatus main assembly by the user alone. For this reason, the maintenance of the apparatus main assembly is easy.

Therefore, the cartridge in the present invention includes the process cartridges of the so-called the integral type and the so-called separation type. The cartridge includes a pair of the process cartridge of the separation type and the developing cartridge. In another example of the cartridge, the electrophotographic photosensitive drum is mounted fixedly in the apparatus main assembly or the cartridge supporting member and the detachably mountable developing cartridge is used so as to be actable on the electrophotographic photosensitive drum.

[First Embodiment]

FIG. 1 is a schematic sectional view of a laser printer which is a color electrophotographic image forming apparatus in this embodiment. The general constitution of the image forming apparatus will be described.

<General Constitution of Color Electrophotographic Image Forming Apparatus>

First, referring to FIG. 1, the general constitution of the color electrophotographic image forming apparatus according to this embodiment will be described. FIG. 1 is a sectional illustration of the image forming apparatus in this embodiment.

The image forming apparatus 100 is a laser printer of a four color-based full-color type which uses an electrophotographic process. The image forming apparatus 100 forms an image on a recording material (sheet) on the basis of an image signal input from an external host device (not shown) such as a personal computer, an image reader, a remote facsimile machine.

In the image forming apparatus 100, a front side is a side which is provided with an openable apparatus door (opening and closing member) 33. A rear side (backside) is the opposite side from the front side. The left and the right are the left and the right, as seen from the front side of the image forming apparatus.

As shown in FIG. 1, in an image forming apparatus main assembly 100, first to fourth process cartridge P (Pa, Pb, Pc, Pd) are horizontally juxtaposed from the rear side to the front side. The process cartridges P have the structures which are similar to each other except that the colors of the accommodated developers are different from each other. A cartridge Pa accommodates a yellow developer. A cartridge Pb accommodates a magenta developer. A cartridge Pc accommodates a cyan developer. Pd accommodates a black developer.

In this embodiment, the cartridge P of the so-called integral type is used but the present invention is not limited thereto. The cartridge P may have the structure described above.

An upper portion of the cartridge P mounted in the main assembly 100*a* is provided with a laser scanner unit 3. A scanner unit 3 scanningly exposes the surface of the photosensitive drums 1 (1*a*, 1*b*, 1*c*, 1*d*) of each cartridge P to a laser beam. As a result, an electrostatic latent image is sequentially formed on the photosensitive drum 1. Subsequently, the electrostatic latent image is developed by the developing means 2 (2*a*, 2*b*, 2*c*, 2*d*), so that a developer image is formed on the photosensitive drum 1.

Below the cartridge P mounted in the apparatus main assembly 100*a*, an intermediary transfer belt 4 is provided. The intermediary transfer belt 4 is stretched around a driving roller 5, a follower roller 6, and a tension roller 7, and is rotated in the clockwise direction in FIG. 1. A lower surface of the photosensitive drum 1 of each cartridge P contacts an upper-side surface of the intermediary transfer belt 4. This contact position of each cartridge P is an image forming position. Inside the intermediary transfer belt 4, four primary transfer rollers 8 (8*a*, 8*b*, 8*c*, 8*d*) are disposed opposite to the four photosensitive drums 1 (1*a*, 1*b*, 1*c*, 1*d*) of the cartridges P.

Opposite to the follower roller 6, a secondary transfer roller 9 is disposed in contact with the intermediary transfer belt 4. At an upper rear portion in the apparatus main assembly 100*a*, a fixing device 10 and a discharge roller pair 11 are disposed. At an upper surface of the apparatus main assembly 100*a*, a discharge tray 12 is disposed.

During the image formation, the developer images formed on the respective photosensitive drums 1 are successively transferred onto the intermediary transfer belt 4 to provide color images on the intermediary transfer belt 4. In synchronism with this image forming operation, the recording material 14 stacked and accommodated in a sheet feeding tray 13 disposed at a lower portion of the apparatus main assembly 100*a* is fed by a sheet feeding roller 15. The fed recording material 14 is conveyed to a nip between the intermediary transfer belt 4 and the secondary transfer roller 9.

Then, the developer image transferred on the intermediary transfer belt 4 is transferred onto the recording material 14 in the nip. The recording material 14 on which the developer image is transferred is sent to the fixing device 10 in which the developer image is heated and pressed. As a result, the developer image is fixed on the recording material 14.

The recording material 14 having the developer image fixed thereon is discharged to the discharge tray 12 by the discharge roller pair 11.

In this embodiment, for the usability improvement, the cartridge tray 31 (cartridge supporting member) is pulled out from the apparatus main assembly 100*a* toward the front side in the state in which the cartridges P are supported on (accommodated in) the cartridge tray 31. As a result, the user can exchange the cartridge 33 from the front side, of the apparatus main assembly 100*a*, on which the door 33 is provided. The cartridge tray 31 is slidably provided relative to the apparatus main assembly 100*a*.

<Cartridge Tray>

Figure 2:
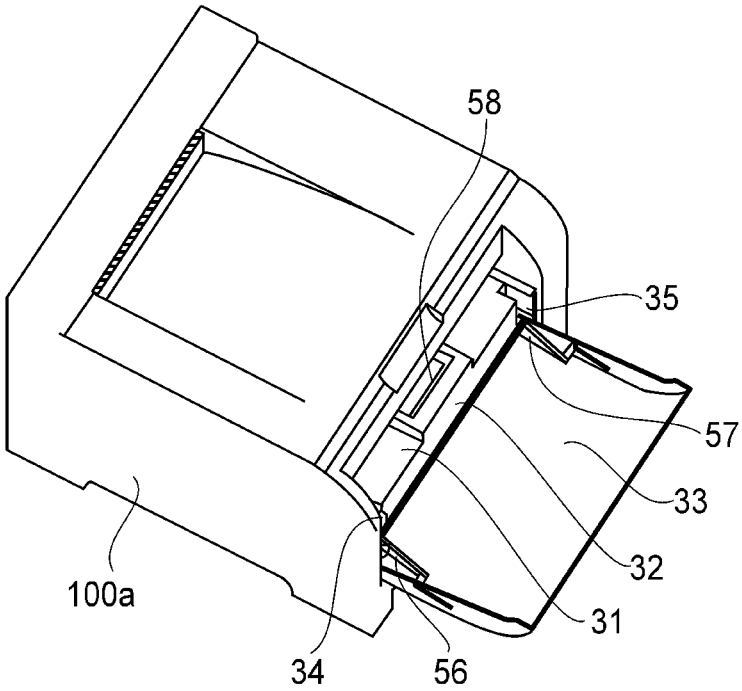
FIG. 2 is a perspective view of the image forming apparatus in First Embodiment when a door is opened.
Figure 3:
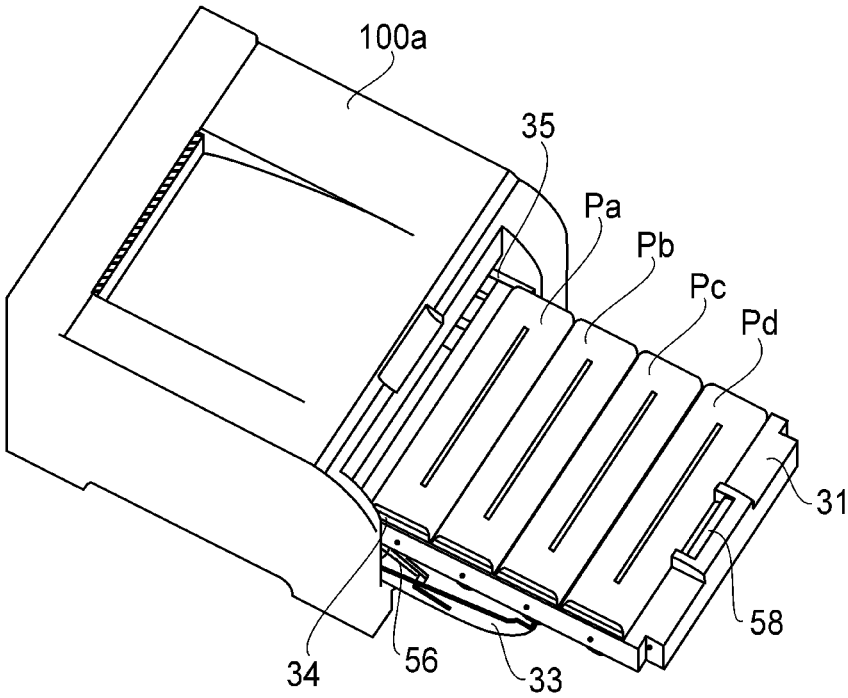
FIG. 3 is a perspective view of the image forming apparatus in First Embodiment when a cartridge tray is pulled out.

Referring to FIGS. 2 and 3, an operation constitution of the cartridge tray 31 will be described.

In each of the first to fourth cartridges P, the developer contained in the developing device is consumed as it is used for the image formation. When the developer is consumed up to the extent such that an image of a quality satisfactory to the user which has purchased the cartridge P cannot be formed, an exchange of the cartridge P is required.

In the image forming apparatus in this embodiment, for the usability improvement, the exchange of the cartridge P performed in the state in which the cartridge P is placed on the cartridge tray 31 in accordance with a so-called front access exchange method.

The cartridge tray 31 is movable, while supporting the cartridge P, between an inside position inside the apparatus main assembly 100*a* and an outside position outside the apparatus main assembly 100*a*.

For this reason, on the front (surface) side of the apparatus main assembly 100*a*, an opening 32 for permitting passing of the cartridge P therethrough to insert the cartridge P in 3 to the apparatus main assembly 100*a* and to demount the cartridge P from the apparatus main assembly 100*a*.

The door (opening and closing member) 31 movable between a closed position for covering the opening 32 and an open position for uncovering the opening 32 is provided.

In this embodiment, the door 33 is openable and rotatable about a hinge shaft 33*a* (FIG. 1) provided on a lower side of the door 33. That is, the door 33 is rotationally moved about the hinge shaft 33*a*, thus being placed in a closed state in which the apparatus main assembly 100*a* is covered. By this closing of the door 33, the opening 32 is covered. Further, by rotationally moving the door 33 about the hinge shaft 33*a* toward the front side of the apparatus main assembly 100*a*, the door 33 can be placed in an open state in which the apparatus main assembly 100*a* is uncovered. As a result, the opening 32 located at the front surface of the apparatus main assembly 100*a* is largely exposed. A pair of left and right tray holding members (movable means) 34 and 35 is disposed inside and an end portions of the opening 32 while extending in a front-rear direction which is a longitudinal direction. Between the left and right tray holding members 34 and 35, the cartridge tray 31 which is a frame-like member is horizontally held slidably and movably in the front-rear direction. The cartridge P is supported by the cartridge tray 31.

The tray holding members 34 and 35 and the door 33 are connected through door arms 56 and 57. When the door 33 is opened, the door arms 56 and 57 connected with the door 33 are rotationally moved to obliquely raise the tray holding members 34 and 35.

The cartridge tray 31 is prevented from moving in the front-rear direction of the apparatus main assembly 100*a* by a tray stopper 59 described later, so that the cartridge tray 31 is raised by the tray holding members 34 and 35 relative to the apparatus main assembly 100*a*. As a result, the cartridge P supported by the tray holding members 34 and 35 is raised relative to the apparatus main assembly 100*a*, so that the photosensitive drum 1 is separated from the intermediary transfer belt 4 and is slidably movable in the front-rear direction of the main assembly.

When the cartridge tray 31 is pulled out from the apparatus main assembly 100*a*, a tray lever 58 is pushed toward the apparatus main assembly front side, so that the tray stopper 59 which prevents the movement of the cartridge tray 31 toward the main assembly front direction is released. Then, the cartridge tray 31 is slid relative to the tray holding members 34 and 35, thus being slidably moved horizontally in the front direction so as to be pulled out. As a result, the cartridge tray 31 is sufficiently pulled out through the opening 32 to a predetermined pulling-out position outside the apparatus main assembly 100*a* (FIG. 3).

Thus, all the four (first to fourth) cartridges P pass through the opening 32 and are exposed to the outside of the apparatus main assembly 100*a*, so that upper surfaces of all the cartridges P are exposed.

When the cartridge tray 31 is pulled out to the predetermined pulling-out position, further pulling-out movement of the cartridge tray 31 is prevented by a stopper portion (not shown). The state in which the cartridge tray 31 is horizontally pulled out to the predetermined pulling-out position is kept by the tray holding members 34 and 35. In this state, each cartridge P can be demounted right above.

<Drum Shutter>

Next, a drum shutter (shutter member) 37 will be described.

The cartridges P supported by the cartridge tray 31 are provided with cartridge openings 36 (36*a*, 36*b*, 36*c*, 36*d*) (FIG. 1) for exposing the photosensitive drums 1 as a process member. Further, the cartridge tray 31 is provided with the drum shutters 37 (37*a*, 37*b*, 37*c*, 37*d*) for covering and uncovering the cartridge openings 36. The respective drum shutters 37 have the same constitution.

The transfer residual developer electrostatically deposited on the surface of the photosensitive drum 1 is collected by a cleaning member 40 in a cleaning device 26 (26*a*, 26*b*, 26*c*, 26*d*) and is accumulated as a so-called residual toner in the cleaning device 26.

The drum shutter 37 performs a function of not exposing the photosensitive drum 1 in a state in which the cartridge tray 31 is pulled out. The drum shutter 37 also performs a function of receiving the residual toner so that the residual toner in the cleaning device 26 is not scattered in a disposition place by impact of the pulling-out of the cartridge tray 31. For that reason, the drum shutter 37 is moved, in the state in which the cartridge tray 31 is pulled out (at the outside position), to the closed position in which the drum shutter 37 is located right below the photosensitive drum 1 and the cartridge opening 36 is covered.

Figure 4:
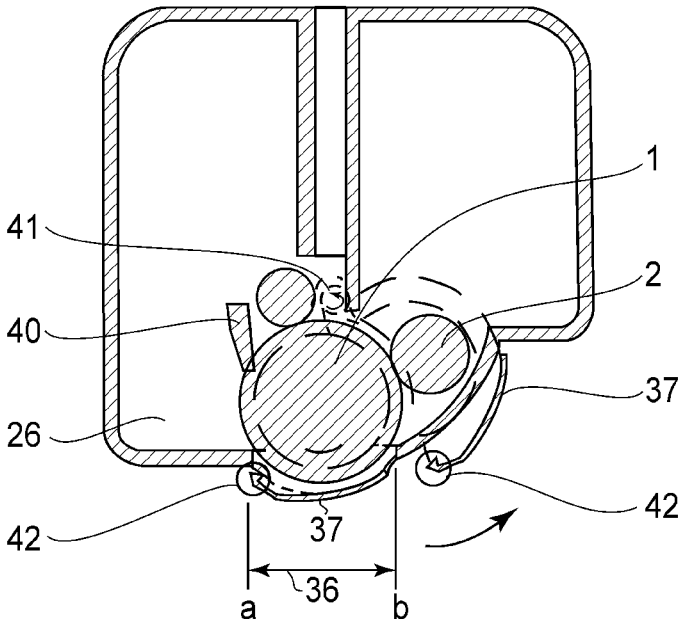
FIG. 4 is a sectional view of a cartridge and a drum shutter in First Embodiment.

When the cartridge tray 31 is located at a latent image forming position (inside portion) inside the apparatus main assembly, the drum shutter 37 is rotationally moved about a drum shutter supporting portion 41 in a counterclockwise direction as shown in FIG. 4 so that the photosensitive drum 1 contacts the intermediary transfer belt 4 and the toner image can be transferred from the photosensitive drum 1 onto the belt 4.

Figure 5:
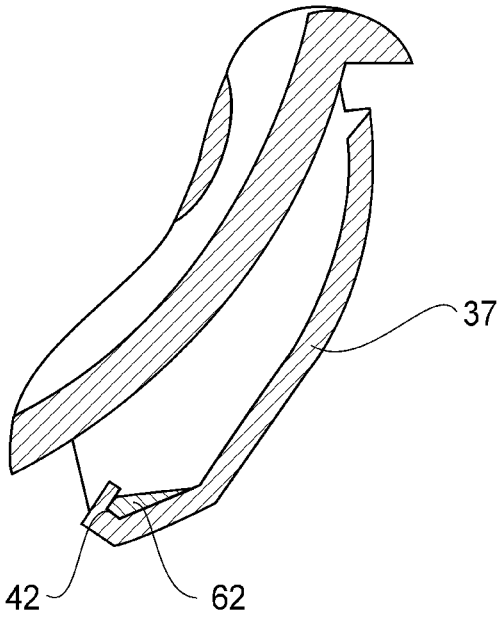
FIG. 5 is an enlarged sectional view of the drum shutter in First Embodiment.

When the drum shutter 37 is moved to the closed position, as shown in FIG. 5, the drum shutter 37 is provided with a residual toner containing portion 42 with a bent end portion so that the residual toner received by the drum shutter 37 is not scattered in the apparatus main assembly. The residual toner containing portion 42 is provided for the purpose of storing the developer so that the residual toner 62 is not scattered within the apparatus main assembly when the drum shutter 37 is located at the open position, and therefore may also be formed with a rib or a groove.

<Drum Shutter Moving Means>

Next, a constitution of a shutter moving means for moving the drum shutter 37 to the open position and the closed position will be described with reference to FIGS. 6 to 11.

Figure 6:
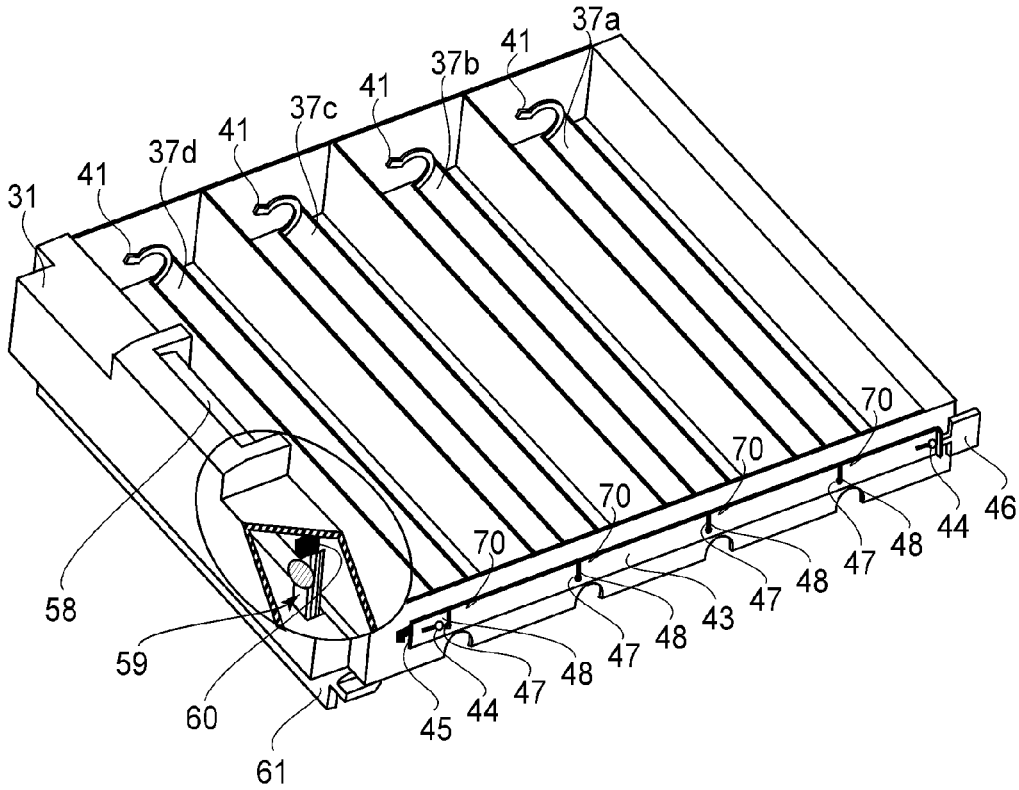
FIG. 6 is a perspective view of the cartridge tray in First Embodiment when the cartridge tray is accommodated in an apparatus main assembly in state in which the door is opened.

FIG. 6 is a perspective view of the cartridge tray 31 when the cartridge tray 31 is located at the position (inside position) in which the cartridge tray 31 is accommodated in the apparatus main assembly in state in which the door is opened.

Figure 7:
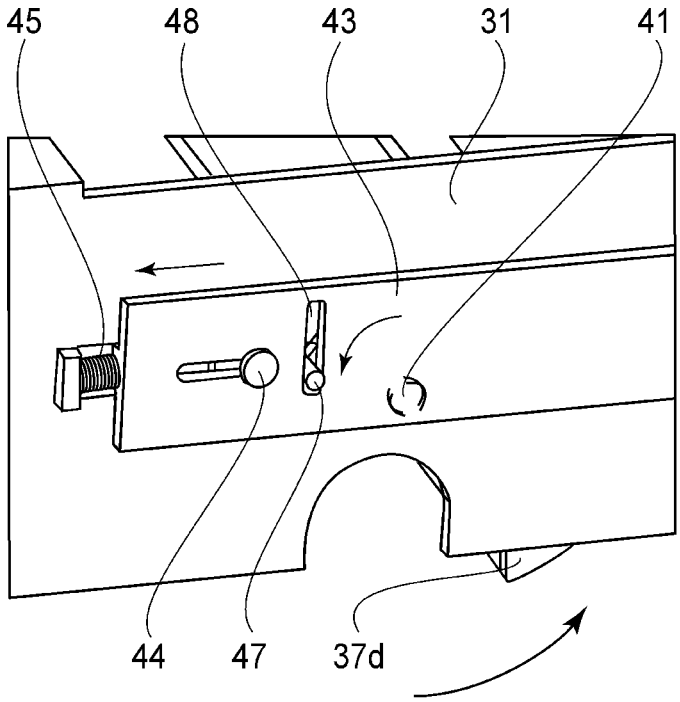
FIG. 7 is a perspective view of a front portion of a link member in First Embodiment when the cartridge tray is accommodated in the apparatus main assembly in the state in which the door is opened.

FIG. 7 is a perspective view of a front portion of a link member 43 when the cartridge tray 31 is located at the inside position in which the cartridge tray 31 is accommodated in the apparatus main assembly in the state in which the door is opened.

Figure 8:
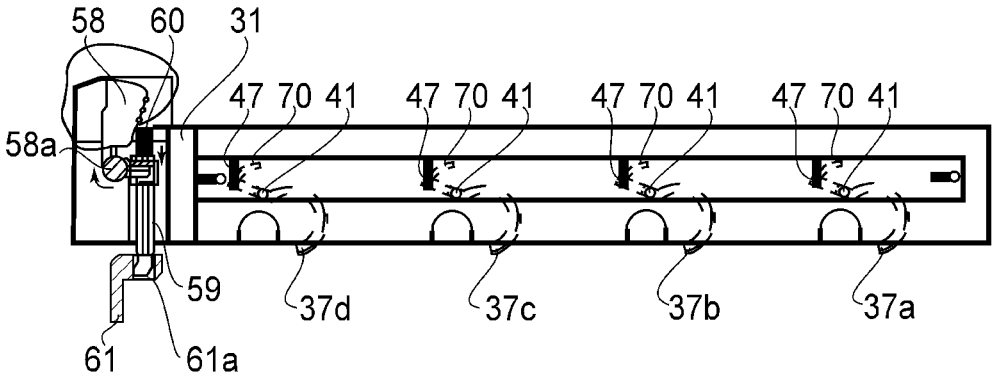
FIG. 8 is a sectional view of a tray lever and its adjacent portions in First Embodiment when the cartridge tray is accommodated in the apparatus main assembly in the state in which the door is opened.

FIG. 8 is a sectional view of a tray lever and its adjacent portions when the cartridge tray 31 is accommodated in the apparatus main assembly in the state in which the door is opened.

Figure 9:
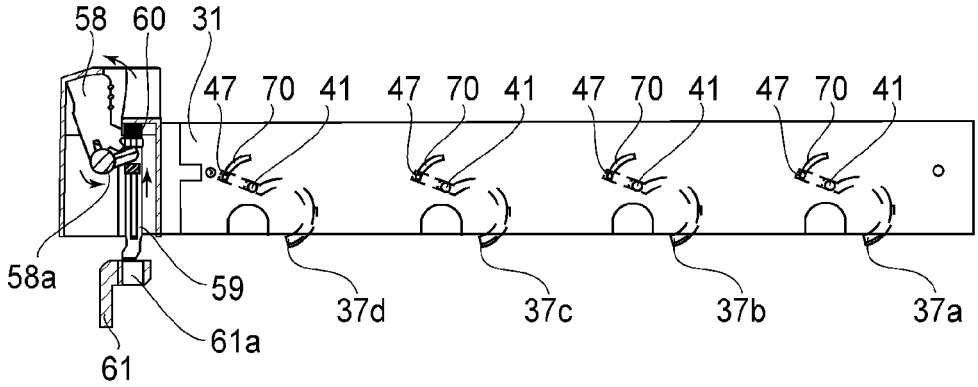
FIG. 9 is a sectional view of the tray lever and its adjacent portions in First Embodiment when the cartridge tray is pulled out in the state in which the door is opened.

FIG. 9 is a sectional view of the tray lever and its adjacent portions when the cartridge tray 31 is pulled out in the state in which the door is opened.

Figure 10:
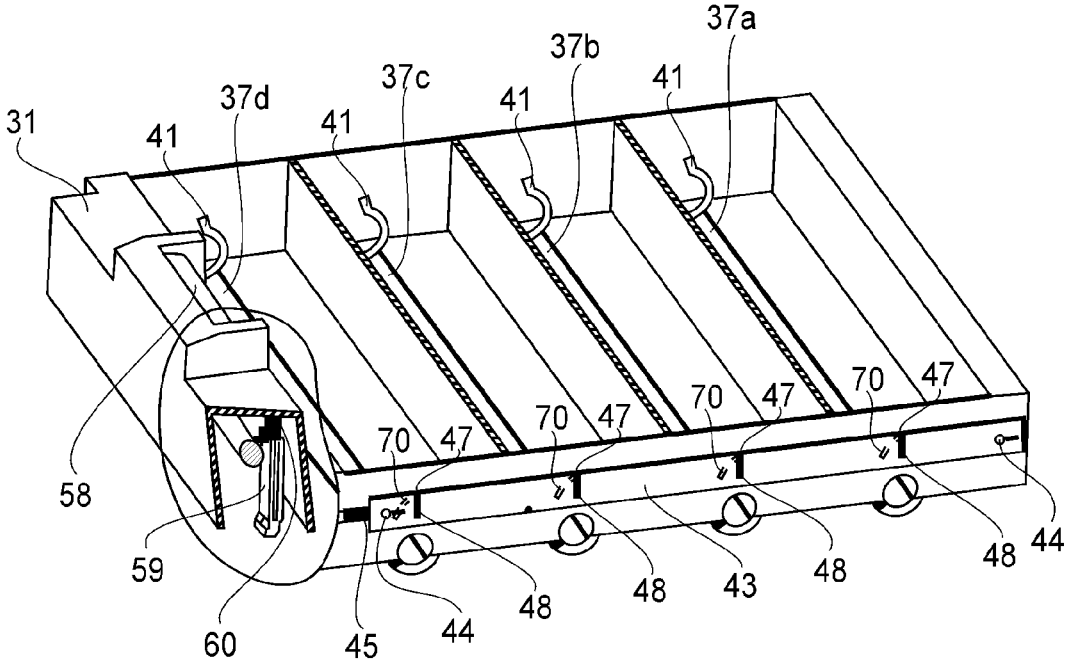
FIG. 10 is a perspective view of the cartridge tray in the state in which the cartridge tray is pulled out from the apparatus main assembly in First Embodiment.

FIG. 10 is a perspective view of the cartridge tray 31 when the cartridge tray 31 is pulled out to a cartridge demounting position (outside position) in the state in which the door is opened.

Figure 11:
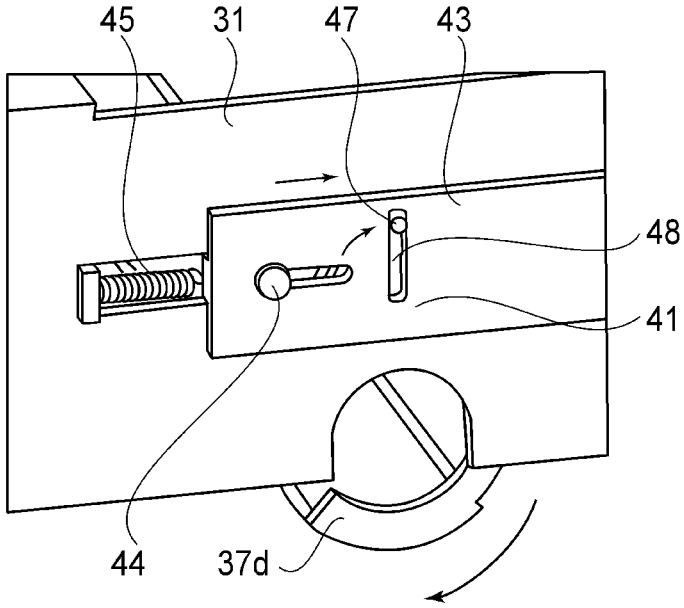
FIG. 11 is a perspective view of the front portion of the link member in the state in which the cartridge tray is pulled out from the apparatus main assembly in First Embodiment.

FIG. 11 is a perspective view of the front portion of the link member 43 when the cartridge tray 31 is pulled out to the cartridge demounting position (outside position) in the state in which the door is opened, as seen from above the apparatus main assembly.

First, a constitution relating to an operation of the drum shutter 37 will be described.

On the cartridge tray 31, the link member (movable member) 43 is attached movably in the front-rear direction by front and rear (two) link supporting members 44. On a front right side of the cartridge tray 31, a compression spring (urging means) 45 for urging the link member 43 in one direction is attached and is disposed between the link member 43 and the cartridge tray 31.

On a rear side of the link member 43, an urging member 46 (FIG. 6) fixed on the apparatus main assembly side. As a result, when the cartridge tray 31 is accommodated inside the apparatus main assembly in the state in which the door is opened, the urging member 46 urges, against an urging force of the compression spring 45, the link member 43 so as to move the front-side position of the apparatus main assembly. As a result, in the compression spring 45, a force for urging the cartridge tray 31 toward the front-side of the apparatus main assembly is generated.

Further, as shown in FIG. 8, the cartridge tray 31 is provided with a tray lever 58 rotationally movable about a rotation shaft 58*a* at its grip portion. Further, a tray stopper 59 connected with the tray lever 58 is provided movable in the vertical direction of the apparatus main assembly by the rotational movement of the tray lever 58.

The tray stopper 59 is urged in a downward direction of the apparatus main assembly by a compression spring 60 disposed between the tray stopper 59 and the cartridge tray 31. As a result, a lower end of the tray stopper 59 is inserted into a cut hole 61*a* of a casing 61 fixed on the apparatus main assembly side when the cartridge tray 31 is accommodated inside the apparatus main assembly, so that the cartridge tray 31 is fixed against the urging force of the compression spring 60. At this time, the tray lever 58 is rotationally moved clockwise and is held at a home position.

In the cartridge tray 31, the drum shutters 37 are provided correspondingly to the respective cartridges P and are attached to the cartridge tray 31 so as to be rotatable about left and right drum shuttering portions 41. Further, as shown in FIG. 9, a drum shutter boss 47 is provided at one end of each drum shutter 37 and is engaged in a cut hole 48 provided in the link member 43. As a result, the link member 43 and the drum shutter 37 are engaged with each other, so that when the link member 43 moves in the front-rear direction, the drum shutter 37 is rotationally moved in interrelation with the drum shutter 37. Incidentally, in the cartridge tray 31, an arcuate cut-away portion 70 is provided so that an associated drum shutter boss 47 is rotationally movable.

In the above constitution, when the cartridge tray 31 is accommodated inside the apparatus main assembly (at the inside position). As shown in FIGS. 6 and 7, the urging member 46 fixed in the apparatus main assembly urges the link member 43 against the urging force of the compression spring 45 so as to move the link member 43 to the front-side position of the apparatus main assembly. For this reason, the drum shutter boss 47 is pushed toward the main assembly front side by the link member 43, so that the drum shutter 37 is rotationally moved to the open position which is an exposure position in which the cartridge opening 36 is opened to expose the photosensitive drum 1.

Next, in order to move the cartridge tray 31 to the outside position which is the cartridge demounting position outside the apparatus main assembly, the door 33 is opened and the tray lever 58 is rotationally moved in the counterclockwise direction as shown in FIG. 9. As a result, the tray stopper 59 is raised toward the upper side of the apparatus main assembly and is disengaged from the cut hole 61*a* of the casing 60. As a result, the cartridge tray 31 is pushed out toward the main assembly front side by the urging force of the compression spring 45.

By the movement of the cartridge tray 31 toward the main assembly front side, the link member 43 is separated from the urging member 46 and is moved to the main assembly rear side by the urging force of the compression spring 45. As a result, as shown in FIGS. 10 and 11, the drum shutter boss 47 is pushed toward the main assembly rear side by the link member 43, so that the drum shutter 37 rotationally moves the photosensitive drum 1 to the closed position which is a protection position in which the door 1 is protected by the drum shutter 37.

Further, when the cartridge tray 31 is moved from the outside position to the inside position, the drum shutter 37 is moved to the closed position by an operation which is the reverse of the above-described operation.

Thus, in interrelation with the pulling-out operation of the cartridge tray 31, the drum shutter 37 provided in the cartridge tray 31 can be moved, so that usability can be improved.

Further, the compression spring 45 applies not only the urging force for moving the link member 43 relative to the cartridge tray 31 but also the urging force for pushing out the cartridge tray 31 from the apparatus main assembly. Therefore, there is no need to separately provide a spring or the like for pushing out the cartridge tray 31 from the apparatus main assembly, so that the number of parts can be reduced.

[Second Embodiment]

Next, a color electrophotographic image forming apparatus in this embodiment will be described with reference to FIGS. 12 to 15.

In this embodiment, when the shutter moving means moves the cartridge tray 31 from the inside position to the outside position, before the plurality of cartridges P supported by the cartridge tray 31 is successively exposed through the main assembly opening 32, the plurality of drum shutters associated with the plurality of cartridges P are successively moved to the closed position. This is a characteristic feature in this embodiment.

A basic constitution of the image forming apparatus in this embodiment is identical to that in First Embodiment and therefore a constitution of the shutter member moving means different from that in First Embodiment will be described, so that other redundant descriptions will be omitted. Further, in this embodiment, members or means having the same functions as those in First Embodiment are represented by the same reference numerals or symbols.

Figure 13:
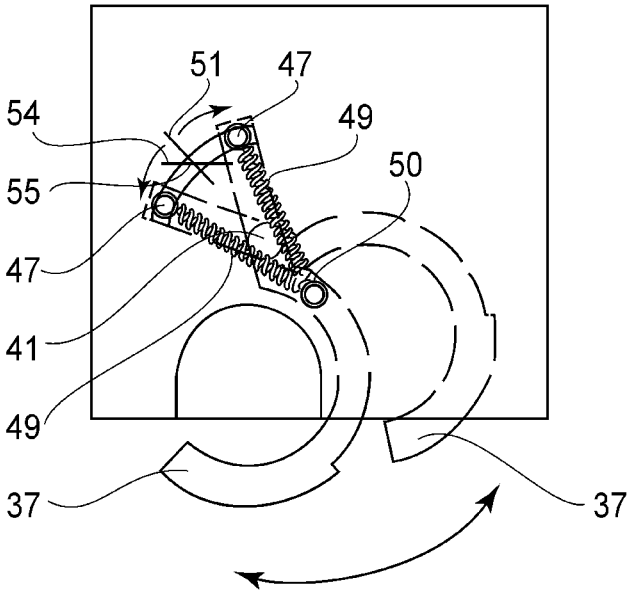
FIG. 13 is a side view of a drum shutter and its adjacent portions in Second Embodiment as seen from a driving side.
Figure 12:
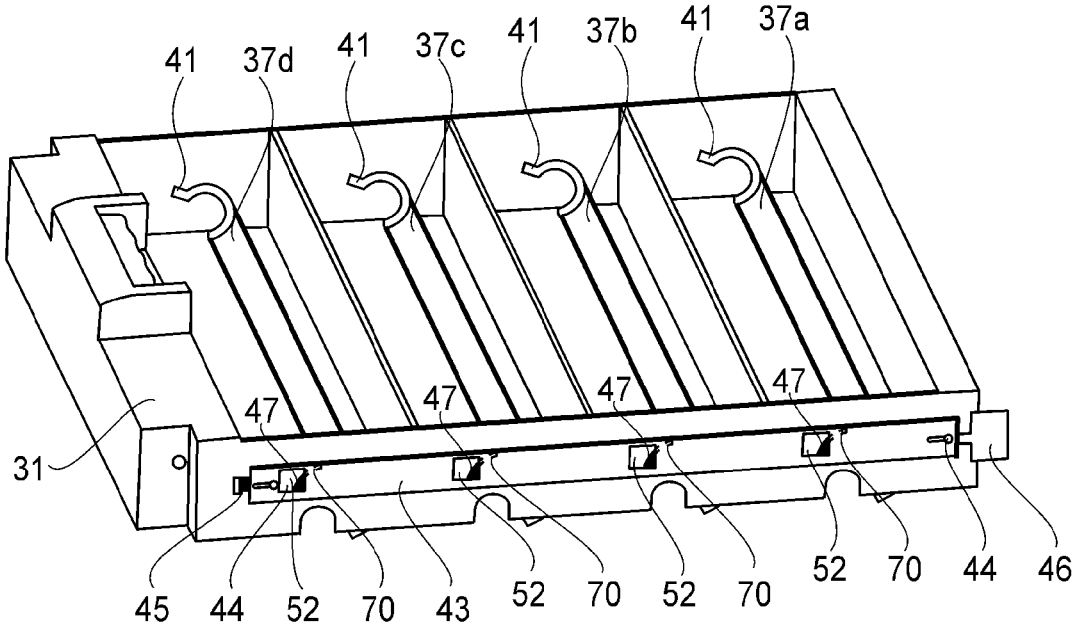
FIG. 12 is a perspective view of a cartridge tray in Second Embodiment when the cartridge tray is accommodated in an apparatus main assembly in a state in which a door is opened.
Figure 14:
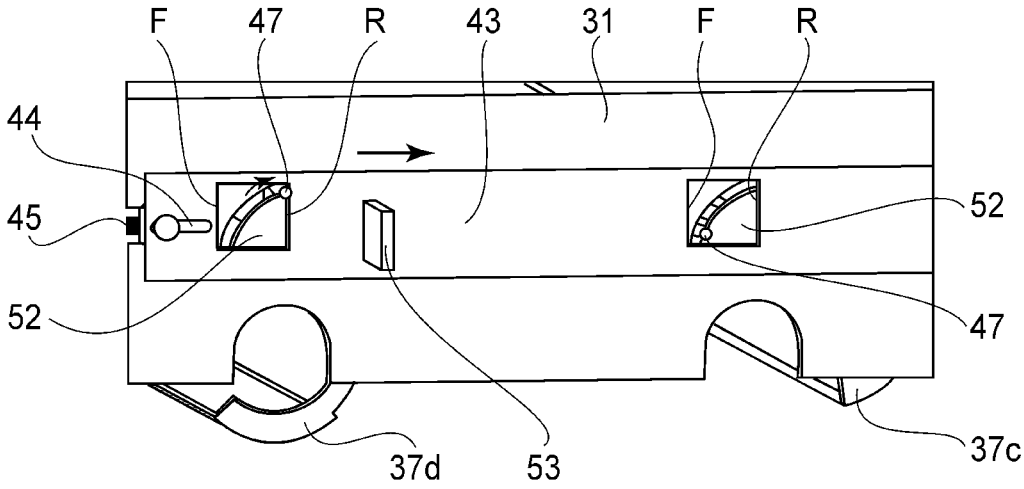
FIG. 14 is a perspective view of a front portion of a link member in Second Embodiment when the cartridge tray is partly pulled out from the apparatus main assembly.
Figure 15:
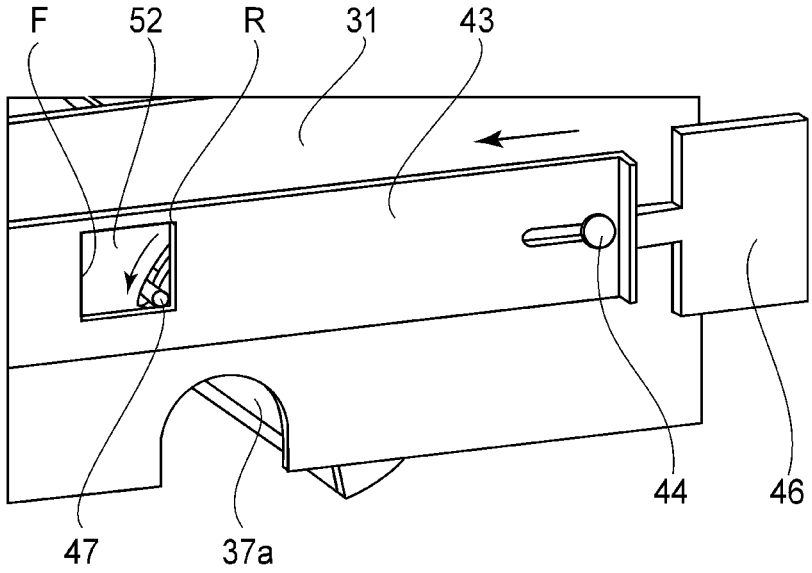
FIG. 15 is a perspective view of a rear portion of the link member in Second Embodiment when the cartridge tray is accommodated in the apparatus main assembly in the state in which the door is opened.

FIG. 12 is a perspective view 31 of the cartridge tray 31 in when the cartridge tray 31 is accommodated in the apparatus main assembly in the state in which the door is opened. FIG. 13 is a side view of the drum shutter 37 and its adjacent portions as seen from a driving side. FIG. 14 is a perspective view of the front portion of the link member 43 when the cartridge tray is partly pulled out from the apparatus main assembly. FIG. 15 is a perspective view of the rear portion of the link member 43 when the cartridge tray 31 is accommodated in the apparatus main assembly in the state in which the door is opened.

On the cartridge tray 31 in this embodiment, as shown in FIG. 13, a spring supporting point 50 is formed and projected from the cartridge tray 31 at a predetermined position on an opposite side from the side where the drum shutter boss 47 is provided while a drum shutter supporting portion 41 is located between the spring supporting point 50 and the drum shutter boss 47. Further, a tension spring 49 is hook-bridged between the drum shutter boss 47 and the spring supporting point 50.

For this reason, when the drum shutter 37 is rotated and the drum shutter boss 47 is located on the main assembly front side (the left side in FIG. 13) with respect to a line 51 connecting a spring movement center 55 and the spring supporting point 50, a force of the tension spring 49 for rotationally moving the drum shutter 37 in the counterclockwise direction in FIG. 13 is generated. On the other hand, when the drum shutter boss 47 is located on the main assembly rear side (the right side in FIG. 13) with respect to the line 51 connecting the spring movement center 55 and the spring supporting point 50, a force of the tension spring 49 for rotationally moving the drum shutter 37 in the clockwise direction in FIG. 13 is generated.

As a result, a so-called toggle mechanism for retaining the open position state when the drum shutter 37 is located at the open position and for retaining the closed position state when the drum shutter 37 is located at the closed position is constituted.

Further, as shown in FIG. 14, the drum shutter boss 47 enters a cut-away hole 52 cut in the link member 43. The cut-away hole 52 is provided by largely cutting away the link member 43 in the front-rear direction, and a side surface F on the main assembly front side is formed by cutting away the link member 43 so that the side surface F does not interfere with the drum shutter boss 47 when the link member 43 is located on the main assembly rear side.

A side surface R on the main assembly rear side is formed by cutting away the link member 43 so that the side surface R is located on the main assembly front side relative to the spring movement center 55 shown in FIG. 13 when the link member 43 is positioned on the main assembly front side.

At an intermediate position of the pulling-out of the cartridge tray 31, an urging rib 53 which is contactable to the drum shutter boss 47 and which is fixed on the main assembly side. A height of the urging rib 53 is higher than a horizontal line 54 including the spring movement center 55 shown in FIG. 13 but when the drum shutter boss 47 is positioned on the main assembly rear side, the urging rib 53 does not contact the drum shutter boss 47.

In the above constitution, when the cartridge tray 31 is accommodated inside the apparatus main assembly. As shown in FIG. 15, the urging member 46 fixed in the apparatus main assembly 100*a* urges the link member 43 against the urging force of the compression spring 45 so as to move the link member 43 to the front-side position of the apparatus main assembly 100*a*. For this reason, all the drum shutter boss 47 are pushed toward the main assembly front side, with respect to the line 51 connecting the spring movement center 55 and the spring supporting point 50, by the side surface R of the cut-away hole 52 of the link member 43 as shown in FIG. 13. For this reason, the drum shutter 37 is rotationally moved in the counterclockwise direction shown in FIG. 13 by the urging force of the tension spring 49, so that all the drum shutters 37 are moved to the open position.

Next, in order to move the cartridge tray 31 to the outside position which is the cartridge demounting position outside the apparatus main assembly, the door 33 is opened and the tray lever 58 is rotationally moved in the counterclockwise direction as shown in FIG. 9. As a result, the tray stopper 59 is raised toward the upper side of the apparatus main assembly and is disengaged from the cut hole 61*a* of the casing 60. As a result, the cartridge tray 31 is pushed out toward the main assembly front side by the urging force of the compression spring 45.

By the movement of the cartridge tray 31 toward the main assembly front side, the link member 43 is separated from the urging member 46 which has urged the link member 43 toward the main assembly front side, and is moved to the main assembly rear side by the urging force of the compression spring 45.

At this time, the side surface F of the cut-away hole 52 on the main assembly front side does not interfere with the drum shutter boss 47.

Then, in the case where the cartridge tray 31 is pulled out, when the fourth cartridge Pd located most frontward with respect to the tray pulling-out direction reaches an entrance position in which it just comes out of the apparatus main assembly through the opening 32 at the apparatus main assembly front surface, the urging rib 53 (FIG. 14) fixed on the apparatus main assembly engages with the drum shutter boss 47. As a result, the drum shutter boss 47 of the fourth drum shutter 37*d* is urged toward the main assembly rear side relative to the line 51 (FIG. 13) connecting the spring movement center 55 and the spring supporting point 50, so that the drum shutter boss 47 is rotationally moved in the clockwise direction by the urging force of the tension spring 49 and therefore the drum shutter 37*d* is moved to the closed position.

Here, the drum shutter 37 is moved to the closed position by the shutter moving means immediately before the front-side end of the cartridge opening 37 to be covered and uncovered with the drum shutter 37 is exposed from the main assembly opening 32. That is, the drum shutter 37 is moved to the closed position immediately before a portion a of the cartridge opening 36 (extending from the portion a to a portion b with respect to the pulling-out direction) shown in FIG. 4 passes through the end portion (portion c shown in FIG. 1) of the main assembly opening 32.

After the drum shutter 37 is moved to the closed position, the drum shutter boss 47 is held by the urging force of the tension spring 49 on the main assembly rear side where the urging rib 53 does not contact the drum shutter boss 47. For this reason, the urging rib 53 and the drum shutter boss 47 do not interfere with each other, so that the cartridge tray 31 can be pulled out.

Next, similarly as in the case of the fourth drum shutter 37*d*, the third to first drum shutters 37*c*, 37*b* and 37*a* are successively pulled out to the position of the urging rib 53 and are successively moved to their closed positions, respectively.

As a result, before the openings of the plurality of cartridges supported by the cartridge tray 31 are successively exposed from the main assembly opening 32, the drum shutters 37 associated with the respective cartridges are successively moved to their closed positions.

Thus, timing when each of the plurality of drum shutters is operated in deviated, so that a force for operating each drum shutter may be small even when the plurality of drum shutters are employed.

Incidentally, when the cartridge tray 31 is pulled out, the link member 43 is moved to the main assembly rear side by the compression spring 45. However, the main assembly front-side side surface F of the cut-away hole 52 for the drum shutter 37 is cut away to the position in which the side surface F does not interfere with the drum shutter boss 47 when the link member 41 is positioned on the main assembly rear side, so that the side surface F does not prevent the drum shutter 37 to move to the protection position (the closed position).

In the above-described manner, in interrelation with the pulling-out operation of the cartridge tray 31, the drum shutter 37 provided in the cartridge tray 31 can be moved with the timing immediately before the opening of each cartridge passes through the front surface opening 32 of the apparatus main assembly.

As a result, the photosensitive drum can be prevented from being exposed and it is possible to protect the disposition place from being contaminated with the scattered developer by the impact of the pulling-out of the cartridge tray 31.

Further, the compression spring 45 is used only for operating the link member 43 and therefore the spring pressure can be reduced, so that the operating force for moving the cartridge tray 31 into the apparatus main assembly can be alleviated.

[Other Embodiments]

In Second Embodiment, each drum cartridge is moved to the closed position immediately before the opening of the cartridge is exposed from the main assembly opening but is not necessarily moved immediately before the cartridge opening exposure. That is, in order to prevent the photosensitive drum 1 from being exposed, the drum shutter may only be required to be moved to the closed position before the cartridge opening is exposed from the main assembly opening.

Figure 16:
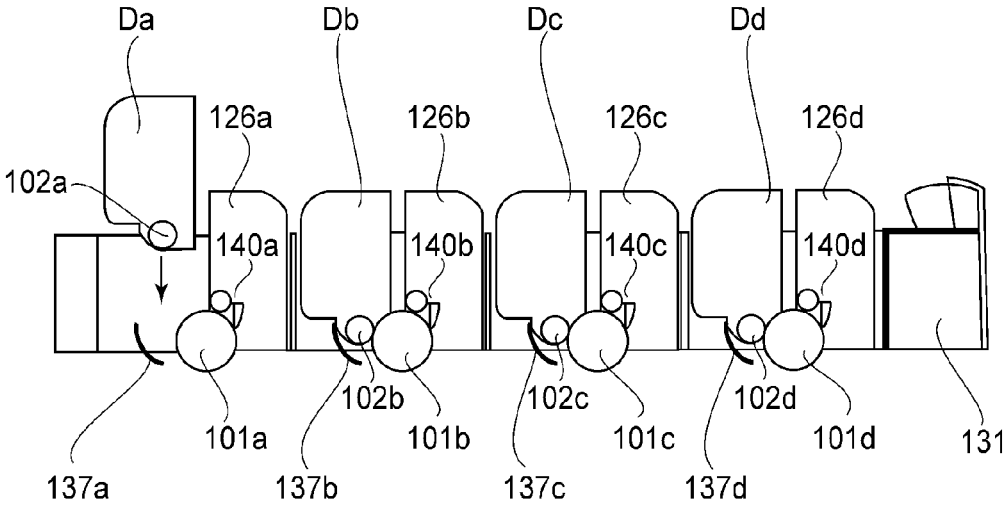
FIGS. 16 and 17 are sectional views each showing a cartridge tray in another embodiment.

Further, in First and Second Embodiments, the process cartridge prepared by integrally supporting the photosensitive drum and the developing device and the like is used as the cartridges supported by the cartridge tray 31. However, in the present invention, as shown in FIG. 16, developing cartridges Da to Dd which include developing rollers 102*a* to 102*d* and are configured to develop electrostatic latent images formed on photosensitive drums 101*a* to 101*d* provided in a cartridge tray 131 may also be employed. Each of the developing cartridges Da to Dd is detachably mountable to the cartridge tray 131. In this case, shutter members 137*a* to 137*d* for protecting the photosensitive drums 101*a* to 101*d* are configured to be openable and closable. Other constitutions and effects are similar to those in First and Second Embodiments.

Figure 17:
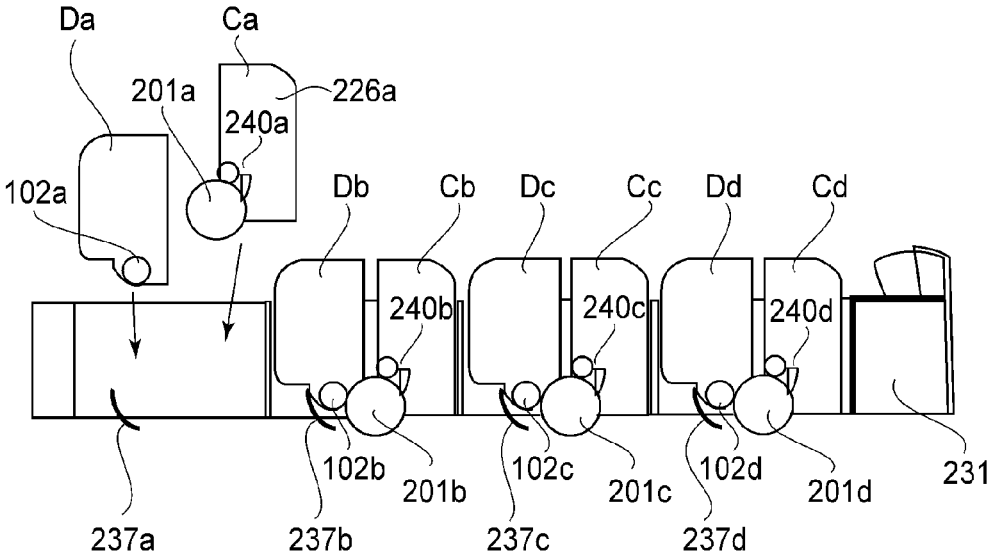

In the present invention, it is also possible to employ a constitution shown in FIG. 17. In this constitution, in addition to the developing cartridges Da to Dd, drum cartridges Ca to Cd are also detachably mountable to the cartridge tray 131. The drum cartridges Ca to Cd include cleaning means 240*a* to 240*d* for removing residual toners from the surfaces of photosensitive drums 201*a* to 201*d*. Also in this case, shutter members 237*a* to 237*d* for protecting the photosensitive drums 201*a* to 201*d* are configured to be openable and closable. Other constitutions and effects are similar to those in First and Second Embodiments.

In the present invention, the shutter member is provided in the cartridge supporting member for supporting the cartridges, so that there is no need to provide the shutter member in the cartridges which are consumables. For this reason, the cost of the consumables can be reduced. Further, the shutter member covers and uncovers the cartridge opening in interrelation with the movement of the cartridge supporting member, so that the improvement in usability can be realized and it is possible to prevent failure in closing the shutter member or the like.

Further, in the image forming apparatus including the cartridge supporting member, for support the plurality of cartridges, movable between the inside position inside the apparatus main assembly and the outside position outside the apparatus main assembly, the following effect is achieved. That is, at the outside position, the photosensitive member supported by the cartridge supporting member can be protected from being exposed to light.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications No. 179746/2009 filed Jul. 31, 2009 and Patent Applications No. 158366/2010 filed Jul. 13, 2010, which is hereby incorporated by reference.

What is claimed is:

1. A color electrophotographic image forming apparatus for forming an image on a recording material, wherein a plurality of cartridges is detachably mounted to a main assembly of said apparatus, said color electrophotographic image forming apparatus comprising:

a cartridge supporting member for supporting the cartridges, said cartridge supporting member being movable between an inside position inside the main assembly and an outside position outside the main assembly;

a shutter member movably provided on said cartridge supporting member, said shutter member being movable between an open position in which a photosensitive member supported by said cartridge supporting member is exposed and a closed position in which the photosensitive member is protected; and shutter moving means for moving said shutter member to the closed position when said cartridge supporting member is moved from the inside position to the outside position and for moving said shutter member to the open position when said cartridge supporting member is moved from the outside position to the inside position.

2. An apparatus according to claim 1, wherein said shutter moving means includes a movable member which is movably provided on said cartridge supporting member and is engaged with said shutter member and includes urging means for urging said movable member in one direction, and wherein said shutter member is movable between the open position and the closed position by movement of said movable member.

3. An apparatus according to claim 2, wherein said urging means applies an urging force for moving said movable member relative to said cartridge supporting member and applies an urging force for pushing out said cartridge supporting member from the main assembly.

4. An apparatus according to claim 1, wherein said shutter moving means moves, when said cartridge supporting member is moved from the inside position to the outside position, said shutter member to the closed position before the cartridges supported by said cartridge supporting member come out of the main assembly through an opening provided in the main assembly.

5. An apparatus according to claim 1, wherein said shutter member includes a plurality of shutter member portions provided correspondingly to the plurality of cartridges, respectively, and wherein said shutter moving means moves, when said cartridge supporting member is moved from the inside position to the outside position, said shutter member portions successively to associated closed positions before the cartridges supported by said cartridge supporting member come out of the main assembly through an opening provided in the main assembly.

6. An apparatus according to claim 4, wherein said shutter moving means moves said shutter member to the closed position immediately before an associated cartridge comes out of the main assembly through the opening.

7. An apparatus according to claim 1, wherein each of the cartridges includes the photosensitive member and process means actable on the photosensitive member.

* * * * *